US010866041B2

(12) United States Patent
Michut

(10) Patent No.: US 10,866,041 B2
(45) Date of Patent: Dec. 15, 2020

(54) AUTOMATIC FIREARM BREECH MECHANISM

(71) Applicant: Viktor Michut, Stiavnik (SK)

(72) Inventor: Viktor Michut, Stiavnik (SK)

( * ) Notice: Subject to any disclaimer, the term of this patent is extended or adjusted under 35 U.S.C. 154(b) by 0 days.

(21) Appl. No.: 16/468,076

(22) PCT Filed: Dec. 21, 2017

(86) PCT No.: PCT/SK2017/050012
§ 371 (c)(1),
(2) Date: Jun. 10, 2019

(87) PCT Pub. No.: WO2018/117983
PCT Pub. Date: Jun. 28, 2018

(65) Prior Publication Data

US 2020/0072567 A1 Mar. 5, 2020

(30) Foreign Application Priority Data

Dec. 22, 2016 (SK) ..... 50089-2016

(51) Int. Cl.
*F41A 3/44* (2006.01)
*F41A 3/66* (2006.01)
*F41A 3/54* (2006.01)

(52) U.S. Cl.
CPC ..... *F41A 3/44* (2013.01); *F41A 3/66* (2013.01); *F41A 3/54* (2013.01)

(58) Field of Classification Search
CPC ..... F41A 3/44; F41A 3/46; F41A 3/54; F41A 3/66
See application file for complete search history.

(56) References Cited

U.S. PATENT DOCUMENTS 4,232,583 A * 11/1980 Harrison ..... F41A 3/44 89/153
6,079,138 A * 6/2000 Meaker ..... F41A 3/44 42/17

FOREIGN PATENT DOCUMENTS

| | | | |
|---|---|---|---|
| BG | 99340 | A | 7/1996 |
| EP | 1363099 | A1 | 11/2003 |
| SK | 512007 | A3 | 11/2008 |

OTHER PUBLICATIONS

International Search Report and Written Opinion of the International Search Authority issued in PCT Application No. PCT/SK2017/050012 dated Apr. 16, 2018.

(Continued)

*Primary Examiner* — J. Woodrow Eldred
(74) *Attorney, Agent, or Firm* — Leonardpatel P.C.; Michael Aristo Leonard, II; Sheetal Suresh Patel

(57) ABSTRACT

An automatic firearm breech mechanism is provided that ensures that the delaying roller remains an integral part of the breech mechanism after removing the breech mechanism from the firearm. The automatic firearm breech mechanism may include a breech, a breech carrier, and a delaying roller that is positioned between a rear vertical wall of the breech and a front vertical wall of the breech carrier. The delaying roller may move vertically while between the rear vertical wall of the breech and the front vertical wall of the breech carrier. A modified cage may surround the working area of the delaying roller. The cage may be a strip bent into the shape of an inverted letter "U," featuring an opening located on its horizontal wall, while its vertical walls are fitted with a slide stop at both ends.

12 Claims, 1 Drawing Sheet

(56) References Cited

OTHER PUBLICATIONS

Michal Bencur, "Systémy samonabíjacích pištoli," available at https://www.vojsko.net/vyzbroj-pechoty/78-ostatni/547-systemy-samonabijacich-pistoli (last accessed Jun. 10, 2019).

* cited by examiner

[Fig. 1]
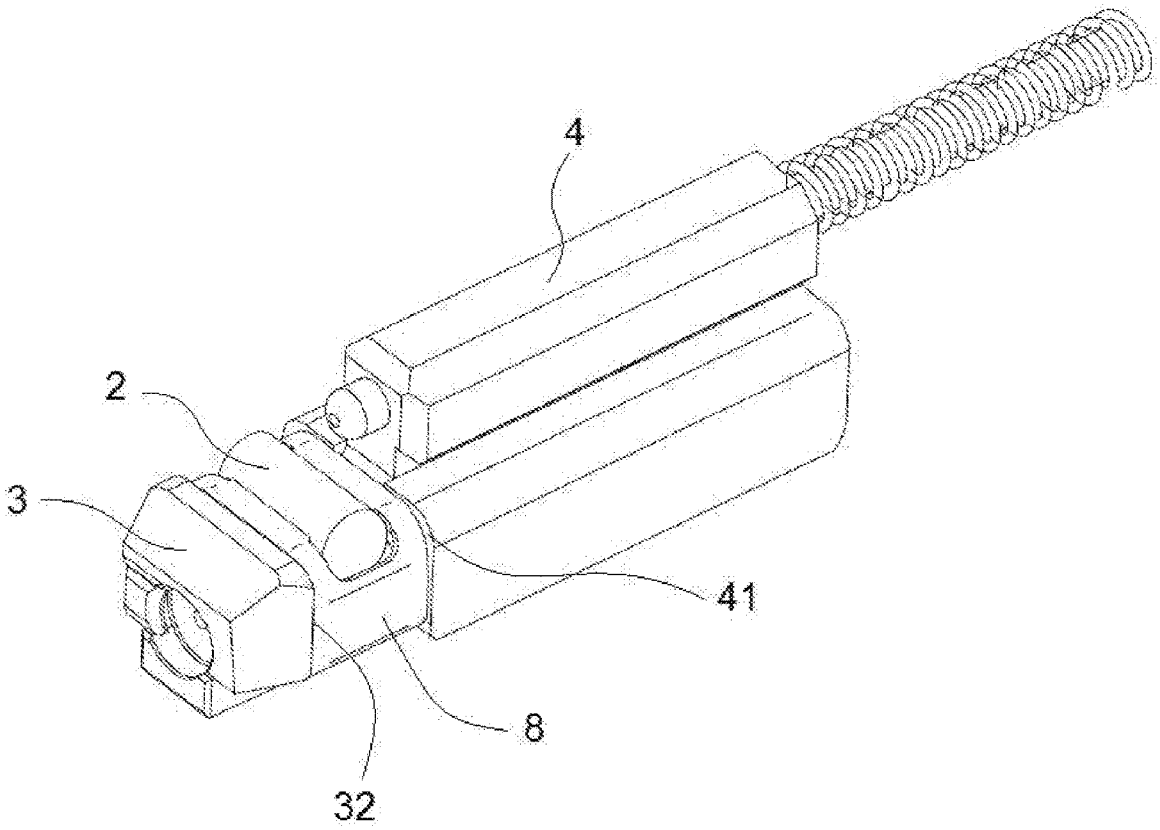
[Fig. 2]
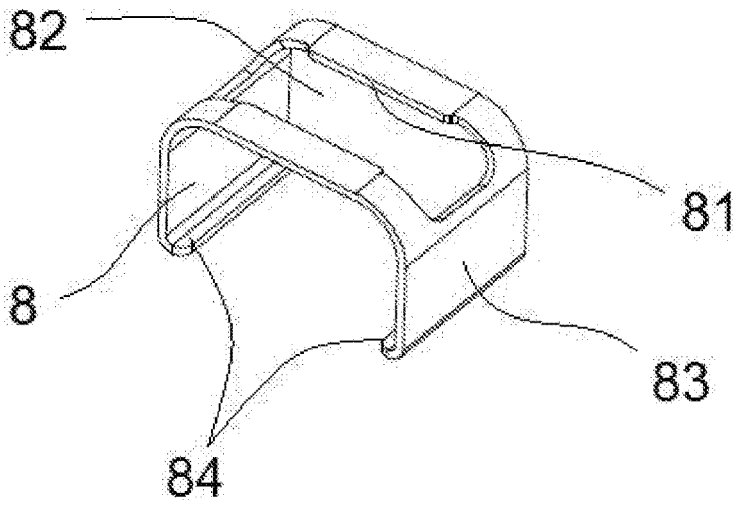

AUTOMATIC FIREARM BREECH MECHANISM

CROSS REFERENCE TO RELATED APPLICATIONS

This application is a U.S. national stage application under 35 U.S.C. § 371 of PCT Application Number PCT/SK2017/050012 filed Dec. 21, 2017, which claims the benefit of Slovakian Patent Application Number PP 50089-2016 filed Dec. 21, 2016. The subject matter of these earlier filed patent applications is hereby incorporated by reference in its entirety.

FIELD

The invention generally pertains to firearms, and more particularly, to an automatic breech mechanism for a firearm, which may be suitable for small caliber automatic firearms whose breech is slowed by a roller.

BACKGROUND

The design of an automatic firearm breech mechanism described in Slovakian Patent No. SK 287526 includes a shaped opening in a locking block permanently attached to the barrel, in which the breech is placed along the longitudinal axis of the barrel. A groove, in which a delaying roller slides when the breech is the locked position, is included on one of the horizontal walls of the shaped opening. The delaying roller is a moving part placed vertically between the rear vertical wall of the breech and the front vertical wall of the breech carrier. There is a supporting surface on the opposite wall of the shaped opening, on which the breech slides with its lower wall. Therefore, when the firearm is assembled, the working area of the delaying roller is constrained by the walls of the shaped opening created in the locking block by the breech and the breech carrier, whereas in the vertical direction, the movement of the delaying roller is constrained by the walls of the shaped opening and the breech.

The delaying roller is placed loosely between the rear vertical wall of the breech and the front vertical wall of the breech carrier. Therefore, during disassembly of the firearm, e.g., when the firearm is being cleaned, the delaying roller, after removing the breech mechanism from the firearm, is not tied to the breech mechanism in any way. This could result in losing the delaying roller.

These considerations gave rise to the task of searching for a design of an automatic firearm breech mechanism with a roller-delayed breech that will allow the delaying roller to perform its function and which will at the same time ensure that the delaying roller will remain an integral part of the breech mechanism after removing the breech mechanism from the firearm. Accordingly, an improved design facilitating these features may be beneficial.

SUMMARY

Certain embodiments of the present invention may provide solutions to the problems and needs in the art that have not yet been fully identified, appreciated, or solved by current firearm breech mechanism technologies. For example, some embodiments of the present invention pertain to an automatic firearm breech mechanism featuring a breech, a breech carrier, and a delaying roller that is positioned between a rear vertical wall of the breech and a front vertical wall of the breech carrier. The delaying roller moves vertically in such embodiments, since a modified cage surrounds the working area of the delaying roller between the rear vertical wall of the breech and the front vertical wall of the breech carrier.

In some embodiments, the cage includes a strip bent into the shape of an inverse letter "U," featuring an opening on the horizontal wall of the strip, while the vertical walls of the strip are fitted with a slide stop at both ends. The width of the opening is smaller than the diameter of the delaying roller, preventing the delaying roller from falling out.

An advantage of the automatic firearm breech mechanism of some embodiments is that it ensures that the delaying roller remains an integral part of the breech mechanism after removing the breech mechanism from the firearm, thus preventing the delaying roller from falling out of the breech mechanism. At the same time, this allows the delaying roller to fully perform its function.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which:

FIG. 1 illustrates a perspective view of a cage mounted in a breech mechanism, according to an embodiment of the present invention.

FIG. 2 illustrates a perspective view of the cage itself, according to an embodiment of the present invention.

DETAILED DESCRIPTION OF THE EMBODIMENTS

Some embodiments of the present invention pertain to an automatic firearm breech mechanism featuring a breech, a breech carrier, and a delaying roller that is positioned between a rear vertical wall of the breech and a front vertical wall of the breech carrier. Referring to FIGS. 1 and 2, the automatic firearm breech mechanism of some embodiments features a breech 3, a breech carrier 4, and a delaying roller 2 that is positioned between the rear vertical wall 32 of the breech 3 and the front vertical wall 41 of the breech carrier 4. A modified cage 8 surrounding the working area of the delaying roller 2 working area is located between the rear vertical wall 32 of the breech 3 and the front vertical wall 41 of the breech 3 carrier 4, and moves vertically. The cage 8 includes a strip bent into the shape of an inverse letter "U," featuring an opening 82 on its horizontal wall 81, while its vertical walls 83 are fitted with a slide stop 84 at both ends. The width of the opening 82 is smaller than the diameter of the delaying roller 2.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An automatic firearm breech mechanism, comprising:
a breech comprising a rear wall;
a breech carrier comprising a front wall;
a delaying roller positioned between the rear wall of the breech and the front wall of the breech carrier, the delaying roller configured to move in a working area; and
a cage surrounding the working area of the delaying roller, wherein
the cage prevents the delaying roller from falling out when the firearm is disassembled,
the cage comprises a bent strip in a shape of an inverted letter "U",
the bent strip comprises a horizontal wall and two vertical walls,
the horizontal wall comprises an opening,
each of the vertical walls are fitted with a slide stop at both ends, and
a width of the opening is smaller than a diameter of the delaying roller.

2. The automatic firearm breech mechanism of claim 1, wherein the rear wall of the breech and the front wall of the breech carrier are vertical walls.

3. The automatic firearm breech mechanism of claim 2, wherein the delaying roller moves vertically between the rear vertical wall of the breech and the front vertical wall of the breech carrier.

4. The automatic firearm breech mechanism of claim 1, wherein the cage is located between the rear vertical wall of the breech and the front vertical wall of the breech carrier.

5. A firearm breech mechanism, comprising:
a delaying roller configured to move in a working area; and
a cage surrounding the working area of the delaying roller, wherein
the cage prevents the delaying roller from falling out when the firearm is disassembled,
the cage comprises a bent strip in a shape of an inverted letter "U",
the bent strip comprises a horizontal wall and two vertical walls,
the horizontal wall comprises an opening,
each of the vertical walls are fitted with a slide stop at both ends, and
a width of the opening is smaller than a diameter of the delaying roller.

6. The firearm breech mechanism of claim 5, further comprising:
a breech comprising a rear wall; and
a breech carrier comprising a front wall, wherein
the delaying roller is positioned between the rear wall of the breech and the front wall of the breech carrier.

7. The firearm breech mechanism of claim 6, wherein the rear wall of the breech and the front wall of the breech carrier are vertical walls.

8. The firearm breech mechanism of claim 7, wherein the delaying roller moves vertically between the rear vertical wall of the breech and the front vertical wall of the breech carrier.

9. The firearm breech mechanism of claim 6, wherein the cage is located between the rear vertical wall of the breech and the front vertical wall of the breech carrier.

10. A firearm breech mechanism, comprising:
a breech comprising a rear wall;
a breech carrier comprising a front wall;
a delaying roller positioned between the rear wall of the breech and the front wall of the breech carrier, the delaying roller configured to move in a working area; and
a cage surrounding the working area of the delaying roller, the cage comprising a bent strip in a shape of an inverted letter "U", wherein
the bent strip comprises a horizontal wall and two vertical walls,
the horizontal wall comprises an opening,
each of the vertical walls are fitted with a slide stop at both ends, and
a width of the opening is smaller than a diameter of the delaying roller.

11. The firearm breech mechanism of claim 10, wherein the rear wall of the breech and the front wall of the breech carrier are vertical walls.

12. The firearm breech mechanism of claim 11, wherein the delaying roller moves vertically between the rear vertical wall of the breech and the front vertical wall of the breech carrier.

* * * * *